United States Patent [19]

Franceschini et al.

[11] 4,155,707

[45] May 22, 1979

[54] WET TRANSFER PROCESS

[75] Inventors: Peter Franceschini, Movelier; Rolf Bäuerle, Riehen; Walter Mosimann, Therwil, all of Switzerland

[73] Assignee: Ciba-Geigy Corporation, Ardsley, N.Y.

[21] Appl. No.: 862,059

[22] Filed: Dec. 19, 1977

[30] Foreign Application Priority Data

Dec. 21, 1976 [CH] Switzerland ..... 16092/76

[51] Int. Cl.[2] ..... D06P 3/02; D06P 3/04; D06P 3/14; D06P 3/24

[52] U.S. Cl. ..... 8/2.5 R; 8/2.5 A

[58] Field of Search ..... 8/2.5 R, 2.5 A

[56] References Cited

U.S. PATENT DOCUMENTS

| | | | |
|---|---|---|---|
| 3,730,676 | 5/1973 | Smith et al. | 8/2.5 |
| 3,792,968 | 2/1974 | Rickenbacher et al. | 8/2.5 |

FOREIGN PATENT DOCUMENTS

| | | |
|---|---|---|
| 639192 | 4/1962 | Canada. |
| 2558926 | 12/1975 | Fed. Rep. of Germany. |

*Primary Examiner*—Stanford M. Levin

*Attorney, Agent, or Firm*—Wenderoth, Lind & Ponack

[57] ABSTRACT

A wet transfer process for dyeing and printing synthetic and natural nitrogenous material by applying to an inert support a printing ink which contains at least one dye and/or fluorescent brightening agent, a binder or thickener, water and/or an organic solvent, and drying said ink, then bringing the treated side of the support into contact with the surface of the material to be dyed which has been pretreated with an aqueous solution or emulsion, subsequently subjecting support and material, with or without mechanical pressure, to a heat treatment of 100° to 130° C., preferably 105° to 120° C., for 1 to 100 seconds, preferably 20 to 60 seconds, and then separating the dyed or printed material from the support, which process comprises the use of a hydrophobic inert support which contains at least one non-sublimable dye having fibre affinity, and pretreating the synthetic and natural nitrogenous fibrous material with an aqueous, thickened solution or emulsion which contains a coacervating agent and an acid or an acid donor.

22 Claims, No Drawings

WET TRANSFER PROCESS

The present invention relates to a wet transfer process for dyeing and printing synthetic and natural nitrogenous fibres.

Wet transfer processes are known and have been described for example in British patent specifications Nos. 1,227,271 and 1,284,824. However, the disadvantage of these known processes is that the dye transfer is only partial. Only in exceptional cases can the incomplete dye transfer be improved by a substantially longer heat treatment and washing and drying operations are necessary before the support can be reused—if at all.

A wet transfer process has now been found which, surprisingly, permits, within 100 seconds, a virtual 100% transfer of all classes of dyes having affinity for nitrogenous material from the hydrophobic support to the substrate, whilst avoiding the above mentioned ecological and economic difficulties, and whereby fast dyeings are simultaneously obtained without a subsequent fixation, for example by steaming.

The novel process comprises subjecting a hydrophobic, inert sheet support which contains at least one nonsublimable dye having fibre affinity, together with the substrate which has been pretreated with an aqueous, thickened solution or emulsion that contains a coacervating agent and an acid or acid donor, to a heat treatment of 100° to 130° C. in the course of 1 to 100 seconds.

Suitable hydrophobic inert supports are for example: metal sheets, for example of stainless steel, but especially dimensionally stable polyester sheets (biaxially orientated polyethylene glycol terephthalate having a thickness of 20 to 175 microns), and also for example paper coated with resins, such as polytetrafluoroethylene and polyurethane, or coated fabrics which are heat stable and dimensionally stable at least up to 130° C.

Since the dye transfer of the present invention is complete, the hydrophobic inert supports can advantageously be reused or used as continuous webs, as described for example in U.S. Pat. No. 3,915,628. Only by this means is it possible to devise the transfer printing process as a fully integrated printing process. The textile printer is, in such a case, no longer dependent on paper printing or the paper printer, but carries out all operations himself in his own plant.

This possibility by itself makes the novel process extremely valuable from the economic and ecological point of view.

Suitable coacervating agents which can be used in the present invention are those which—by themselves or in the presence of additives—together with water form a system with a mixture gap. By coacervating agents are meant substances which are of limited solubility in water, a two-phase area consisting of two liquid phases being present between these limits. Accordingly, a certain amount of, for example, surfactant, must be soluble in water and a certain amount of water must be soluble in the surfactant. In addition, at least one limit of the solubility, namely that of the solubility of the surfactant in water, must not be too high. Such a solubility limit can exist either intrinsically or it can be induced by suitable additives, for example by neutralization with basic or acid assistants, or by addition of electrolytes, such as acetic acid, sodium sulphate, sodium chloride, or also thickeners. These additives make possible or promote the formation of a system with a mixture gap between water and surfactant; but usually they are so readily soluble in water that they themselves do not effect any mixture gap, even if they are liquid substances.

Compounds which fulfill the above conditions and are therefore suitable for the present process are surface-active substances which form hydrophilic colloidal solutions. These film-forming surfactants can be nonionogenic, cationic or anionic, and can belong to compound classes of the most diverse kind.

Nonionogenic coacervating agents which can be used in the present invention are in particular the reaction products of higher molecular weight fatty acids and hydroxylamines and the ethylene oxide adducts thereof. These can be obtained for example from higher molecular weight fatty acids, preferably those containing about 8 to 20 carbon atoms, for example caprylic acid, stearic acid, oleic acid and, in particular, the acid mixture comprised in the collective term "coconut oil fatty acid", and from hydroxyalkylamines, such as triethanolamine or preferably diethanolamine, and mixtures of these amines, the reaction being carried out such that the molecular ratio between hydroxyalkylamine and fatty acid is greater than 1, for example 2:1. Such compounds are described in U.S. Pat. No. 2,089,212.

Good results are also obtained by using amides which are derived from the above mentioned higher molecular weight fatty acids or from dodecyloxyacetic acid, lauryloxyacetic acid and alkylphenoxyacetic acids, the alkyl moieties of which contain 8 to 12, preferably 9, carbon atoms, and from the following hydroxyalkylamines, in the molar ratio 1:1:mono-(hydroxyalkyl)-amines, for example ($\beta$-hydroxyethyl)-amine, ($\gamma$-hydroxypropyl)-amine or ($\beta,\gamma$-dihydroxypropyl)-amine, bis-(hydroxyalkyl)-amines, such as bis-($\beta$-hydroxyethyl)-amine or bis-($\alpha$-methyl-$\beta$-hydroxyethyl)-amine or N-alkyl-N-(hydroxyalkyl)-amines, such as N-methyl- or N-ethyl-N-($\beta$-hydroxyethyl)-amine or N-methyl- or N-ethyl-N-($\gamma$-hydroxypropyl)-amine. The bis-($\omega$-hydroxyalkyl)-amides are preferred, in particular those whose hydroxyalkyl moieties contain 2 or 3 carbon atoms, for example bis-($\beta$-hydroxyethyl)-amides or bis-($\gamma$-hydroxypropyl)-amides of coconut oil fatty acids.

Suitable nonionogenic coacervating agents are also alkylene oxide, especially ethylene oxide, condensation products, individual ethyleneoxy units of which can be replaced by substituted epoxides, such as styrene oxide and/or propylene oxide, of higher fatty acids or of saturated or ununsaturated alcohols having 8 to 20 carbon atoms, or of the above mentioned alkanolamides.

The number of alkyleneoxy groups in these polyglycol ethers shall ensure hydrophilic properties and be so great that the compounds are at least readily dispersible, and preferably soluble, in water. Depending on the nature and composition of the lipophilic constituent of these compounds, the number of the ethyleneoxy groups can be 2 and preferably 4 to upwards of 100. It is often advantageous to use mixtures of these substances containing lower to higher contents of ethyleneoxy groups, the higher water-soluble polyglycol ethers acting as dispersants for the lower polyglycol ethers.

Examples of anionic coacervating agents which can be used in the present invention are:

(1) The sodium, potassium, ammonium, N-alkyl, N-hydroxyalkyl, N-alkoxyalkyl or N-cyclohexylammonium or hydrazinium and morpholinium salts of fatty acids containing 10 to 20 carbon atoms which are termed soaps, for example of lauric, palmitic, stearic or oleic acid, of naphthenoic acids, of resinic acids, such as bietic acid, for example the so-called colophonium soap.

(2) Sulphated N-acylated alkanolamides, for example the sulphated amides of caprylic, pelargonic, capric, lauric, myristic or stearic acid, or of lower fatty acids substituted by alkylphenoxy groups, such as octylacetic or nonylphenoxyacetic acid, with mono- or bis-hydroxyalkylamines, such as β-hydroxyethylamine, γ-hydroxypropylamine, β,γ-dihydroxypropylamine, bis-(β-hyroxyethyl)-amine or with N-alkyl-N-hydroxyalkylamines, such as N-methyl- or N-ethyl-N-(β-hydroxyethyl)-amine.

(3) Sulphated primary or secondary, pure aliphatic alcohols which contain 8 to 18 carbon atoms in the alkyl chain, for example sodium lauryl sulphate, potassium-α-methylstearylsulphate or the sodium salts of coconut fatty alcohol sulphates.

(4) Sulphated unsaturated higher fatty acids or fatty acid esters, such as oleic acid, elaidic acid or ricinolic acid and the lower alkyl esters thereof, for example the ethyl, propyl or butyl esters, and the oils which contain such fatty acids, such as olive oil, castor oil, colza oil.

(5) Sulphated ethylene oxide adducts, such as sulphated adducts of 1 to 20 moles of ethylene oxide with fatty amines, fatty acids or aliphatic alcohols containing 8 to 20 carbon atoms in the alkyl chain, for example with stearylamine, oleylamine, stearic acid, oleic acid, lauryl alcohol, myristyl alcohol, stearyl alcohol or oleyl alcohol; further, the adducts of 1 to 5 moles of ethylene oxide with alkylphenols which have been converted into an acid ester with an organic dicarboxylic acid, such as maleic acid, malonic acid or succinic acid, but preferably with an inorganic polyacid, such as o-phosphoric acid or, in particular, sulphuric acid, and the alkyl moiety of which contains at least 7 carbon atoms, for example the acid sulphuric acid ester of the adduct of 2 moles of ethylene oxide with 1 mole of p-nonylphenol, the acid sulphuric acid ester of the adduct of 1.5 moles of ethylene oxide with 1 mole of p-tert-octylphenol, the acid sulphuric acid ester of the adduct of 5 moles of ethylene oxide with 1 mole of p-nonylphenol, the acid phosphoric acid ester of the adduct of 2 moles of ethylene oxide with 1 mole of p-nonylphenol, the acid maleic acid ester of the adduct of 2 moles of ethylene oxide with 1 mole of p-nonylphenol.

(6) Sulphated esterified polyoxy compounds, for example sulphated, partially esterified polyhydric alcohols, such as sodium salt of the sulphated monoglyceride of palmitic acid.

Instead of the sulphates it is also possible to use esters with other polyvalent mineral acids, for example phosphates.

(7) Primary and secondary alkylsulphonates containing 8 to 20 carbon atoms in the alkyl chain, for example ammonium decylsulphonate, sodium dodecylsulphonate, sodium hexadecanesulphonate-8, sodium stearylsulphonate.

(8) Alkylarylsulphonates, such as alkylbenzenesulphonates with straight or branched alkyl chain containing 7 carbon atoms, for example sodium dodecylbenzenesulphonate, 1,3,5,7-tetramethyloctylbenzenesulphonate, sodium octadecylbenzenesulphonate; or alkyl- and/or aryl-naphthalenesulphonates, for example sodium 1-isopropylnaphthalene-2-sulphonate, sodium 1-tert-butylnaphthalene-2-sulphonate, sodium 1,5-dibutylnaphthalene-2-sulphonate, ammonium 1-benzylnaphthalene-2-sulphonate, potassium 1-diphenyl-naphthalmethane-3-sulphonate, sodium benzylisopropylnaphthalenesulphonate, or the condensation products of the above naphthalene monosulphonic acids with formaldehyde or formaldehyde donors, such as trioxymethylene, for example the dialkyl- or diarylnaphthylmethane-disulphonates, for example di-(1-tert-butyl-2-sulphonaphthalene)-methane, di-(1-benzyl-2-sulphonaphthalene)-methane or di-(1-diphenylmethylene-3-sulphonaphthalene)-methane.

(9) Sulphonates of polycarboxylic acid esters, for example sodium dioctylsulphosuccinate, sodium dihexylsulphophthalate.

The anionic agents are usually in the form of their alkali metal salts, ammonium salts or water-soluble amine salts, for example of the lithium, sodium, potassium, ammonium, β-hydroxylethylamine or dihydroxyethylamine salt.

It is especially advantageous to use mixtures consisting of one of the above mentioned non-ionogenic surfactants, in particular fatty acid alkanolamides, with anionic surfactants, in particular sulphated fatty alcohol polyglycol ethers containing 2 to 10 ether groups, for example the ammonium salt of sulphated lauryl alcohol triglycol ether.

Particularly preferred coacervating agents are the reaction products of fatty acids containing 8 to 20 carbon atoms and hydroxyalkylamines, for example of coconut oil fatty acid and diethanolamine (so-called Kritchevsky bases), sulphated adducts of 1 to 5 moles of ethylene oxide and alkyl phenols, such as the acid sulphuric acid ester of the adduct of 2 moles of ethylene oxide with n-nonylphenol or a mixture of fatty acid alkanolamides with sulphated fatty alcohol polyglycol ethers, for example a mixture of coconut oil fatty acid N-bis-(β-hydroxyalkyl)-amide and the solution salt of sulphated lauryl alcohol diglycol ether.

Cationic coacervating agents which can be used in the present invention are in particular: cetylpyridinium acetate or the quaternized alkylammonium polyglycol ethers described in Swiss patent specification No. 409,991.

The amounts in which the coacervating agents are used in the pretreatment liquors can vary within wide limits, and are advantageously in general from 1 to 100 g, preferably from 5 to 50 g, per liter of one of more coacervating agents.

As further components, the treatment liquor contains in particular an acid, advantageously a non-volatile acid, such as sulphamic acid, citric acid or tartaric acid, or an acid donor, for example diammonium tartrate or glycerin triacetate, and a thickener, for example carubin (locust bean gum), a more or less etherified or esterified mucilage or hydroxylethyl cellulose. In addition to containing these assistants, the pretreatment liquor can advantageously contain a deaerating agent or an antifoam.

Suitable non-sublimable dyes having fibre affinity which can be used in the process of the present invention are the same, preferably water-soluble, organic dyes as are customarily employed in textile dyeing for dyeing the aforementioned nitrogenous fibrous materials, especially textile materials, from an aqueous liquor. Depending on the substrate to be dyed, these dyes are water-soluble ionic or cationic dyes.

The dyes suitable for use in the process of the present invention can belong to the most diverse dyestuff groups. In particular, they are acid, metal complex and cationic dyes of the monoazo, disazo or polyazo series, of the formazane, anthraquinone, nitro, methine, styryl, azastyryl, phthalocyanine or triphenylmethane series.

The water-soluble anionic dyes are in particular the alkali metal or ammonium salts of the so-called wool dyes or of the reactive dyes of the azo, anthraquinone and phthalocyanine series. Suitable azo dyes are preferably metal-free monoazo and disazo dyes which contain one or more sulphonic acid groups, monoazo, disazo and formazane dyes which contain heavy metals, i.e. copper, chromium, nickel or cobalt, and metallised dyes which contain 2 molecules of azo dye bonded to a metal atom. Anthraquinone dyes are in particular 1-amino-4-arylamino-anthraquinone-2-sulphonic acids, and phthalocyanine dyes are in particular sulphurated copper phthalocyanines or phthalocyanine arylamides.

Reactive dyes which contain sulpho groups are water-soluble dyes of the azo, anthraquinone and phthalocyanine series which contain at least one fibre-reactive group, for example a monochlorotriazinyl, monofluorotriazinyl, dichlorotriazinyl, dichloroquinoxalinyl, trichloropyrimidyl, difluorochloropyrimidyl, α-bromoacrylamide group or the β-oxyethylsulphuric acid ester group.

The water-soluble cationic dyes are the customary salts and metal halides, for example zinc chloride double salts, of the known cationic dyes, in particular of the methine, azomethine and azo dyes which contain the indolinium, pyrazolium, imidazolium, triazolium, tetrazolium, oxdiazolium, thiodiazolium, oxazolium, thiazolium, pyridinium, pyrimidinium or pyrazinium ring. Further, cationic dyes of the diphenylmethane, triphenylmethane, oxazine and thiazine dyes are also possible, as well as, finally, dye salts of the arylazo and anthraquinone series with an external onium group, for example an external cycloammonium group or alkylammonium group.

The process of the present invention is also suitable for whitening undyed textile materials with non-sublimable, preferably water-soluble, anionic and cationic fluorescent brightening agents which may belong to any class. In particular, they are stilbene compounds, cumarins, benzocumarins, pyrazines, pyrazolines, oxazines, dibenzoxazolyl or dibenzimidazolyl compounds and naphthalimides.

The amounts in which the dyes are used in the printing inks can vary within wide limits, depending on the desired depth of shade. In general, amounts from 1 to 30 percent by weight, based on the total amount of printing ink, of one or more dyes are advantageous.

Suitable nitrogenous fibrous materials are in particular both those made from wool and from silk.

Suitable synthetic nitrogenous fibrous material as printing substrate is for example acrylonitrile, for example polyacrylonitrile and copolymers of acrylonitrile and other vinyl compounds, such as acrylates, acrylamides, vinyl pyridine, vinyl chloride or vinylidene chloride, copolymers of dicyanoethylene and vinyl acetate, as well as acrylonitrile block copolymers, and, in particular, polyamide materials, such as polyamide 6, polyamide 66 or polyamide 11. Blends of these types of fibre are also possible.

The fibrous material can be in particular in the form of wovens, knitted fabrics, non-wovens or webs, or it can be cut or ready made-up.

The anionic acid, metal complex and reactive dyes are used for example for dyeing fibrous material made from natural polyamides, such as wool and silk, synthetic polyamides, such as polyhexamethylenediamine adipate, poly-ω-caprolactam or poly-ε-aminoundecanoic acid or polyurethane, and the cationic dyes are used for dyeing polyacrylonitrile fibrous material.

The process of the present invention can be carried out for example as follows: printing inks which contain at least one non-sublimable dye and/or fluorescent brightening agent, a binder or thickener, water and/or an organic solvent, are applied to an inert hydrophobic support and dried, then the treated side of the support is brought into contact with the surface of the substrate which has been pretreated with an aqueous solution or emulsion of the composition indicated below, the support and the substrate are then subjected, with or without mechanical pressure, to a heat treatment of 100° to 130° C., preferably 105° to 120° C., for 1 to 100 seconds, preferably 20 to 60 seconds, and the dyed or printed material is subsequently separated from the support and, if desired, washed and dried.

The pretreatment liquor preferably has the following composition:

(a) 0.1 to 10% of a coacervating agent, for example the ammonium salt of the acid sulphuric acid ester of nonylphenol diglycol ether, optionally mixed with octyl alcohol triglycol ether or coconut oil fatty acid N-bis-(β-hydroxyethyl)amide (Kritchevsky bases);

(b) 5 to 20% of a thickener conventionally used in textile printing, such as a guar derivative, a cellulose ether or ester, an etherified carubic acid or a galactomannan derivative;

(c) 0.5 to 5% of an acid, preferably a non-volatile acid, for example tartaric or citric acid;

(d) optionally 0.1 to 1% of a deaerating agent or antifoam; and (e) 65 to 95% of water.

The pH of the pretreatment liquor should preferably be in the range between 2 and 7.

The liquor pick-up, depending on the textile material, is from 60 to 110%, preferably from 60 to 80%.

To remove the assistants and improve the fastness properties, the dyed material is advantageously washed cold and warm and dried.

Besides water, practically all water-miscible and water-immiscible organic solvents or solvent mixtures which boil at atmospheric pressure at temperatures below 200° C., preferable below 130° C., and which have sufficient solubility or emulsifiability (dispersibility), are suitable for obtaining the printing inks. The following may be cited as examples of suitable organic solvents: aliphatic and aromatic hydrocarbons, e.g. n-heptane, cyclohexane, petroleum ether, benzene, xylene or toluene, halogenated hydrocarbons, such as methylene chloride, trichloroethylene, perchloroethylene or chlorobenzene, nitrated aliphatic hydrocarbons, such as nitropropane, aliphatic amides, such as dimethyl formamide or mixtures thereof, also glycols, such as ethylene glycol or ethylene glycol monoalkyl ethers, e.g. ethylene glycol monoethyl ether, diethyl carbonate, dimethyl carbonate, or esters of aliphatic monocarboxylic acid, e.g. ethyl acetate, propyl acetate, butyl acetate, β-ethoxyethyl acetate, aliphatic or cycloaliphatic ketones, for example methyl ethyl ketone, methyl isobutyl ketone, cyclohexanone, isophoron, mesityl oxide, or diacetone alcohol and alcohols, e.g. methanol, ethanol, and, preferably, n-propanol, isopropanol, n-butanol, tert-butanol, sec-butanol, or benzyl alcohol; also suitable are mixtures of the above solvents, e.g. a mixture of methyl ethyl ketone and ethanol in the ratio 1:1.

Particularly preferred solvents are esters, ketones, or alcohols which boil below 120° C., e.g. butyl acetate, acetone, methyl ethyl ketone, ethanol, isopropanol, or butanol.

The desired viscosity of the printing inks can be adjusted by addition of binders, or by dilution with water or a suitable solvent.

Suitable binders are synthetic, semisynthetic, and natural resins, i.e. both polymerization and polycondensation and polyaddition products. In principle, it is possible, to use all resins and binders customarily used in the printing ink and paint industry. The binders should not melt at the transfer temperature, react chemically in the air or with themselves (e.g. crosslink), solely maintain the dyes and/or fluorescent brightening agents at the printed area of the inert support without changing them, and transfer from the support in their entirety to the substrate after the wet transfer process. Preferred binders are those that are soluble in organic solvents and dry rapidly for example in a warm current of air and form a fine film on the carrier. Suitable water-soluble binders are: alginate, tragacanth, carubin (from locust bean gum), dextrin, more or less etherified or esterified mucilages, hydroxyethyl cellulose or carboxymethyl cellulose, water-soluble polyacrylamides or, above all, polyvinyl alcohol; and suitable binders that are soluble in organic solvents are cellulose esters, such as nitrocellulose acetate or butyrate, and, in particular, cellulose ethers, such as methyl, ethyl, propyl, isopropyl, benzyl, hydroxypropyl, or cyanoethyl cellulose, and also mixtures thereof.

The suitability of the printing inks can be improved by adding optional components, for example plasticisers, high boiling solvents such as e.g. tetralin or decalin, ionogenic or non-ionegenic surface active compounds, for example the condensation product of 1 mole of octylphenol with 8 to 10 moles of ethylene oxide.

The liquid, pasty or dry dyeing preparations contain in general 0.1 to 80, advantageously 1 to 30, percent by weight of at least one or more non-sublimable dyes or fluorescent brighteners and optionally 0.5 to 70 percent by weight of a binder, based on the total weight of the preparation, and can be used direct, or after they have been diluted, as printing inks of the invention.

The optionally filtered printing inks are applied to the inert hydrophobic support, for example by spraying, coating, or advantageously by printing the carrier on parts of the surface or over the entire surface. It is also possible to apply to the inert support a multicoloured pattern or to print successively in a base shade and subsequently with similar or different patterns.

After applying the printing inks to the inert support, they are then dried, e.g. by a flow of warm air or by infrared irradiation, with or without recovery of the solvent.

In order to avoid using a printing machine, the printing inks can be sprayed onto the support, for example by using a spray gun. Particularly interesting effects are obtained if more than one shade is printed or sprayed onto the support simultaneously. Furthermore, specific patterns can be obtained for example by using screens or artistic patterns by using a brush. If the carriers are printed, the most diverse forms of printing methods can be employed, for example relief printing (e.g. letterpress printing, flexographic printing), intaglio printing (e.g. roller printing), silkscreen printing (e.g. rotary screen printing, film screen printing) or electrostatic printing.

The pretreatment of the textile substrate is advantageously effected by applying thereto an aqueous solution or emulsion, for example by spraying, padding or some other known method.

The transfer is performed in the conventional manner by the action of heat. The treated supports are brought into contact with the textile material and kept at 100° C. to 130° C. until the dyes or fluorescent brighteners applied to the support are transferred to the material.

The heat can be applied in various known ways, e.g. by passage through a hot heater drum, a tunnel-shaped heating zone or by means of a heated cylinder, advantageously in the presence of an unheated or heated backing roll which exerts pressure, or of a hot calender, or also by means of a heated plate, optionally in vacuo, the various devices being preheated by steam, oil, infrared irradiation or microwaves to the required temperature or being located in the preheated heating chamber.

When the heat treatment is finished, the printed goods are removed from the support and washed.

Compared with known processes, the process of the present invention has notable advantages. The present process has in particular the principal advantage of the now largely solved problem of obtaining strong dyeings and prints which are fast to wet treatments and light on natural and synthetic nitrogenous fibres and blends thereof by the wet heat transfer process while maintaining optimum mechanical fibre properties. The prints obtained by the novel process are characterised by sharply dilineated, finely etched contours. The greatest advantage of the novel process is, however, that a 100% dye transfer is obtained, which was not possible under the hitherto known conditions of wet transfer.

The following Examples illustrate the invention but do not in any way limit the scope thereof. Parts and percentages are by weight.

EXAMPLE 1

(a) 100 g of the dye of the formula

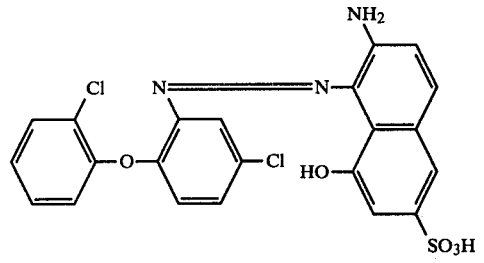

are dissolved in a mixture of 350 g of 95% ethyl alcohol and 100 g of 85% formic acid and the solution is stirred into a stock thickening consisting of 450 g of a 15% hydroxycellulose solution in ethyl alcohol. Using a roller engraved to a depth of 0.03 mm, this printing ink is printed onto a polyester sheet of 36μ to produce a pattern and dried.

(b) Polyamide 66 texturised jersey or woven fabric is padded with a solution consisting of 7 to 20 parts of the ammonium salt of the acid sulphuric acid ester of nonylphenol diglycol ether, 5 parts of a commercially available deaerating agent or antifoam, 150 parts of etherified carubic acid (2.5%) or 10% galactomannan thickener, 10 to 20 parts of tartaric acid in 1,000 parts of water. Pick-up: 70 to 75%.

(c) The printed side of the polyester sheet and the padded textile material are pressed together in a continuous transfer printing machine for 40 seconds at a cylinder temperature of 110° to 112° C. The dye transfer is 100%. After separating the printed material from the support and removing the now colourless polyester sheet, the goods are rinsed cold and warm, then dried. Material provided with a red pattern having the characteristics of a photographic reproduction and sharp outlines, a good handle, and good wetfastness properties is obtained. Similarly good results are obtained by transfer printing on woven and knitted woollen fabrics.

The procedure described in (b) and (c) above is repeated, but using printing inks described in Examples 2 to 6 instead of the printing ink of (a) above, to give red, claret, blue, brown and dark blue prints of similarly good fastness properties on silk, wool, synthetic polyamide material or polyamide/wool mixture with a 100% transfer of the dyes.

EXAMPLE 2

82 g of the dye of the formula

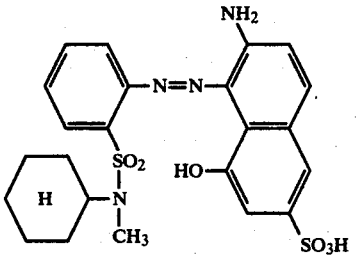

are dissolved in a mixture consisting of 50 g of tetramethylurea, 36 g of dimethyl sulphoxide and 32 g of diethylene glycol monomethyl ether, and the solution is stirred into a stock thickening consisting of 730 g of 95% ethyl alcohol and 70 g of hydroxypropyl cellulose.

EXAMPLE 3

75 g of the dye of the formula

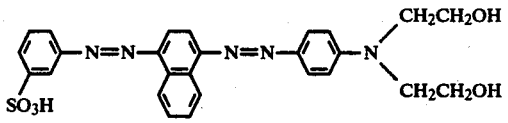

are stirred into a stock thickening consisting of 475 g of water and 450 g of a 15% hydroxypropyl cellulose solution in ethyl alcohol.

EXAMPLE 4

150 g of the dye of the formula

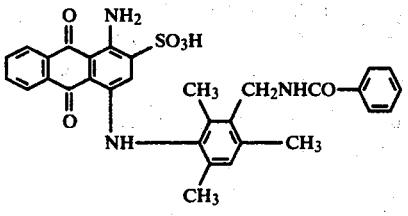

are stirred into a stock thickening consisting of 425 g of water and 425 g of a 15% hydroxypropyl cellulose solution in 95% ethyl alcohol.

EXAMPLE 5

100 g of the dye of the formula

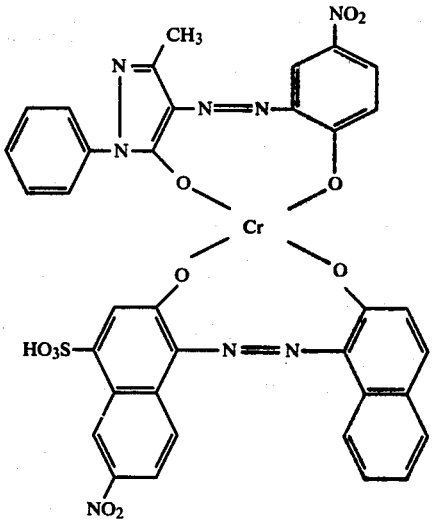

are dissolved in 100 g of diacetone alcohol and 400 g of water and the solution is stirred into a stock thickening consisting of 340 g of ethyl alcohol.

EXAMPLE 6

75 g of the dye of the formula

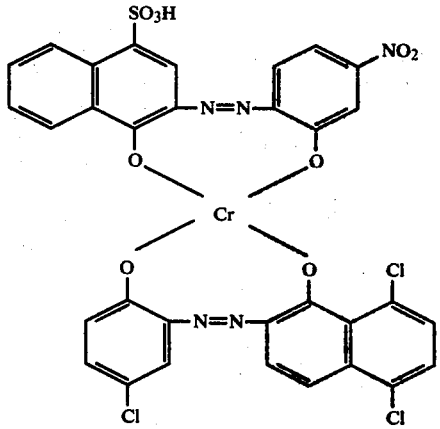

are stirred into a stock thickening consisting of 500 g of water and 425 g of a 15% hydroxypropyl cellulose solution in ethyl alcohol.

EXAMPLE 7

(a) 150 g of the dye of the formula

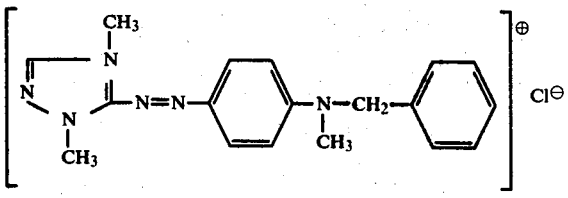

are charged into 300 g of 80% acetic acid and 200 g of ethyl alcohol are added. The solution is then stirred into a stock thickening consisting of 255 g of 95% ethyl alcohol and 45 g of hydroxypropyl cellulose. Using a roller engraved to a depth of 0.005 to 0.03 mm, this printing ink is printed onto a polyester sheet of 36μ to produce a pattern and dried.

(b) Polyacrylonitrile woven fabric (138 g/m²) is padded with a solution consisting of 30 parts of coconut oil fatty acid N-bis-(β-hydroxyethyl)-amide, 5 parts of dinaphthylmethane-disulphonate, 150 parts of a 10% galactomannan thickener, and 20 parts of tartaric acid, in 1000 parts of water. Pick-up: 65 to 70%.

(c) The printed side of the polyester sheet and the padded textile material are pressed together in a continuous transfer printing machine for 60 seconds at a cylinder temperature of 108° to 110° C. After separating the printed material from the support and removing the now colourless polyester sheet, the goods are rinsed cold and then washed at about 50° C. with 2 g/l of stearyl diethylenetriamine. A strong, accurately reproduced light- and wetfast red print is obtained.

EXAMPLE 8

(a) 50 g of the dye of the formula

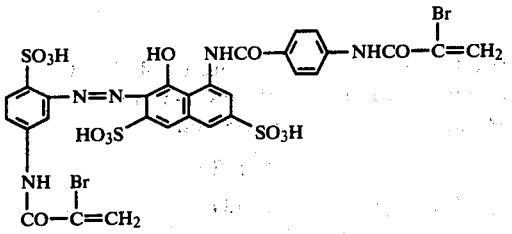

are stirred into a stock thickening consisting of 727 g of 95% ethyl alcohol, 190 g of water and 33 g of hydroxypropyl cellulose and the mixture is ground, with cooling, for 2 to 3 hours in a ball mill until the dye is dissolved. Using a roller engraved to a depth of 0.005 to 0.03 mm, this printing ink is printed onto the following supports and dried:

1. polyester sheeting of 36μ,
2. polypropylene sheeting of 23μ, coated with polyvinylidene chloride,
3. vinyl resin-coated aluminium sheeting of 10μ, bonded to paper on the back,
4. nitro varnish-coated aluminium sheeting of 20μ, bonded to paper on the back.

(b) Bleached woollen muslin (87 g/m²) is padded with a solution consisting of 20 parts of the ammonium salt of the acid sulphuric acid ester of nonylphenol diglycidyl glycol ether,
2 parts of a commercially available deaerating agent or antifoam,
250 parts of of 2.5% etherified carubic acid,
20 parts of glycerin triacetate (triacetin)
10 parts of tartaric acid in 1000 parts of water. Pick-up: 80 to 85%.

(c) The printed side of the above supports and the padded textile material are pressed together in a continuous transfer printing machine for 90 seconds at a cylinder temperature of 115° to 120° C. The dye transfer is 100%. After separating the printed material from the now colourless support and removing this latter, the goods are washed cold, then washed with 2 g/l of stearyl diethylamine at about 60° C., and dried. An accurately reproduced red print is obtained.

(d) The colourless polyester support is freed from thickener residue by rinsing with water and dried. It is again printed with the printing ink described in Example 7(a). The procedure of Example 7(b) and (c) is repeated and a 100% transfer of the dye to the substrate is likewise obtained.

EXAMPLE 9

(a) 150 g of the dye of the formula

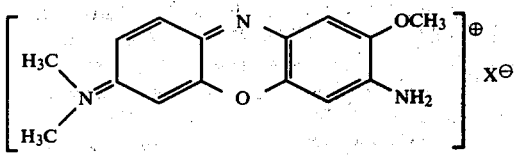

are stirred into a stock thickener consisting of 720 g of 95% isopropyl alcohol, 100 g of water and 30 g of hydroxycellulose. Using a roller engraved to a depth of 0.005 to 0.03 mm, this printing ink is printed onto a vinyl resin-coated aluminium sheet of 10μ which is bonded to paper on the back, and dried.

(b) Polyacrylonitrile woven fabric (138 g/m²) is padded with a solution consisting of 25 parts of coconut fatty acid N-bis-(β-hydroxyethyl)-amide,
2 parts of dinaphthylmethane disulphonate
2 parts of a commercially available deaerating agent or antifoam,
250 parts of a 8% galactomannan thickener,
10 parts of tartaric acid in 1000 parts of water. Pick-up: 80 to 85%.

(c) The printed side of the support and the padded textile material are pressed together in a continuous transfer printing machine for 100 seconds at a cylinder temperature of 115° to 120° C. After separating the printed fabric from the now colourless support and removing this latter, the goods are rinsed cold, then washed with 2 g/l of coconut fatty acid N-bis-(β-hydroxyethyl)-amide at about 50° C., and dried. A strong, accurately reproduced blue print is obtained.

What is claimed is:

1. In a wet transfer process for the dyeing or printing of synthetic or natural nitrogenous fibrous textile material which comprises (1) applying to an inert support a printing ink comprising (a) at least one dye, fluorescent brightening agent or mixtures thereof, (b) a binder or thickener, and (c) water, an organic solvent or mixtures thereof, (2) drying said ink, (3) bringing the treated side of the support into contact with the surface of the said textile material to be dyed said textile material having been pretreated with an aqueous solution or emulsion, (4) subjecting support and textile material while in contact, with or without mechanical pressure, to a heat treatment of 100° to 130° C., for 1 to 100 seconds, and (5) separating the thus dyed or printed material from the support, the improvement wherein the inert support is a hydrophobic inert support, the printing ink contains at least one non-sublimable dye or optical brightening agent having fibre affinity for the said textile material, and the synthetic or natural nitrogenous fibrous textile material is treated prior to contact with the inert support with an aqueous, thickened solution or emulsion which contains (a) a coacervating agent which is a surface-active substance which forms a hydrophilic colloidal solution and (b) an acid or an acid donor.

2. A process according to claim 1 wherein the heat treatment is carried out at a temperature of 105° to 120° C. for 20 to 60 seconds.

3. A process according to claim 1 wherein the coacervating agent is a non-ionogenic or anionic coacervating agent.

4. A process according to claim 3 wherein the non-ionogenic coacervating agent is a reaction product of a higher molecular weight fatty acid and a hydroxylamine and an ethylene oxide adduct of the reaction product.

5. A process according to claim 4 wherein the coacervating agent is a reaction product of a fatty acid of 8 to 20 carbon atoms and a hydroxyalkylamine.

6. A process according to claim 3 wherein the non-ionogenic coacervating agent is an amide derived from a higher molecular weight fatty acid or from dodecyloxyacetic acid, lauryloxyacetic acid or alkylphenoxyacetic acids, the alkyl moiety of which contains 8 to 12 carbon.

7. A process according to claim 3 wherein the non-ionogenic coacervating agent is an alkylene oxide condensation product the individual ethylenoxy units of which can be replaced by substituted epoxides, from the group consisting of styrene oxide or propylene oxide, of alkanolamides, such that the number of alkyleneoxy groups in these polyglycol ethers ensure hydrophilic properties and are so great that the compounds are at least easily dispersible in water.

8. A process according to claim 3 wherein the anionic coacervating agent is the sodium, potassium, ammonium, N-alkyl-, N-hydroxyalkyl-, N-alkoxyalkyl-, N-cyclohexylammonium hydrazinium or morpholinium salt of a fatty acid containing 10 to 20 carbon atoms.

9. A process according to claim 3 wherein the anionic coacervating agent is an adduct of 1 to 5 moles of ethylene oxide and an alkyl phenol which is converted into an acid ester with (a) a dicarboxylic acid from the group of maleic acid, malonic acid and succinic acid or (b) an inorganic polyacid from the group of o-phosphoric acid and sulphuric acid.

10. A process according to claim 3 wherein the anionic coacervating agent is a sulphate of N-acylated alkanolamines.

11. A process according to claim 1 wherein a mixture of a non-ionogenic agent and an anionic agent is used as the coacervating agent.

12. A process according to claim 11 wherein a mixture of a fatty alkanolamide with a sulphated fatty alcohol polyglycol ether containing 2 to 10 ether groups is used as the coacervating agent.

13. A process according to claim 1 wherein a salt of the acid sulphuric acid ester of nonylphenoldiglycol ether is used as the coacervating agent.

14. A process according to claim 1 wherein a mixture of a salt of the acid sulphuric acid ester of nonylphenol diglycol ether and octyl alcohol triglycol ether is used as the coacervating agent.

15. A process according to claim 1 wherein coconut oil fatty acid N-bis($\beta$-hydroxyethyl)-amide is used as the coacervating agent.

16. A process according to claim 1 wherein the aqueous pretreatment solution or emulsion contains the coacervating agent in an amount of 1 to 100 g per liter.

17. A process according to claim 16 wherein the amount is from 5 to 50 g per liter.

18. A process according to claim 1 wherein the inert hydrophobic support is a metal sheet, a dimensionally stable polyester sheet, a polypropylene sheet or resin-coated paper or aluminum sheet, said support being heat stable and dimensionally stable at least up to 130° C.

19. A process according to claim 18 wherein the inert hydrophobic support is a polyester sheet which is heat stable and dimensionally stable up to 130° C.

20. A process according to claim 18 wherein the support is a sheet of stainless steel.

21. A process according to claim 18 wherein the support is in the form of an endless web.

22. A process according to claim 1 wherein the natural or synthetic nitrogenous material to be dyed or printed is selected from the group of wool, silk, acrylonitrile, copolymers of acrylonitrile and other vinyl compounds, copolymers of dicyanoethylene and vinyl acetate, acrylonitrile block copolymers, polyamide material and blends of the above materials.

* * * * *